US005429444A

United States Patent [19]

Warwick

[11] Patent Number: 5,429,444

[45] Date of Patent: Jul. 4, 1995

[54] COLUMN LOCATOR FOR COMPUTER PAGE PLACE MARKER

[76] Inventor: Amparo A. Warwick, 47 Beechwood Dr., Waldorf, Md. 20601

[21] Appl. No.: 820,320

[22] Filed: Jan. 9, 1992

[51] Int. Cl.[6] ..... B41J 29/18

[52] U.S. Cl. ..... 400/706.1; 400/705.4

[58] Field of Search ..... 400/706.1, 705.5, 705.4; 116/240, 235, 234, 237, 236, 321-324, 238, 239, 278

[56] References Cited

U.S. PATENT DOCUMENTS 1,692,742 11/1928 Jacobs .
1,713,994 5/1929 Carter et al. ..... 116/237
2,388,736 11/1945 Germain ..... 116/236
2,879,614 3/1959 Baldanza ..... 116/324
3,061,963 11/1962 Buckley, Jr. ..... 116/234
3,082,944 3/1963 Gubelmann ..... 116/324
3,419,979 1/1969 McVicker et al. ..... 116/324

*Primary Examiner*—Edgar S. Burr
*Assistant Examiner*—Anthony H. Nguyen
*Attorney, Agent, or Firm*—Aquilino & Welsh

[57] ABSTRACT

A column locator for use on a computer page place marker for locating columns of information on a printed computer page. The locator has a jaw-like opening formed of upper and lower legs and a pointer which engages the place marker, permitting slidable movement along a longitudinal edge of the place marker, and includes a lip and abutment shoulder on each leg within the opening to maintain placement of the locator during movement on the place marker.

8 Claims, 1 Drawing Sheet

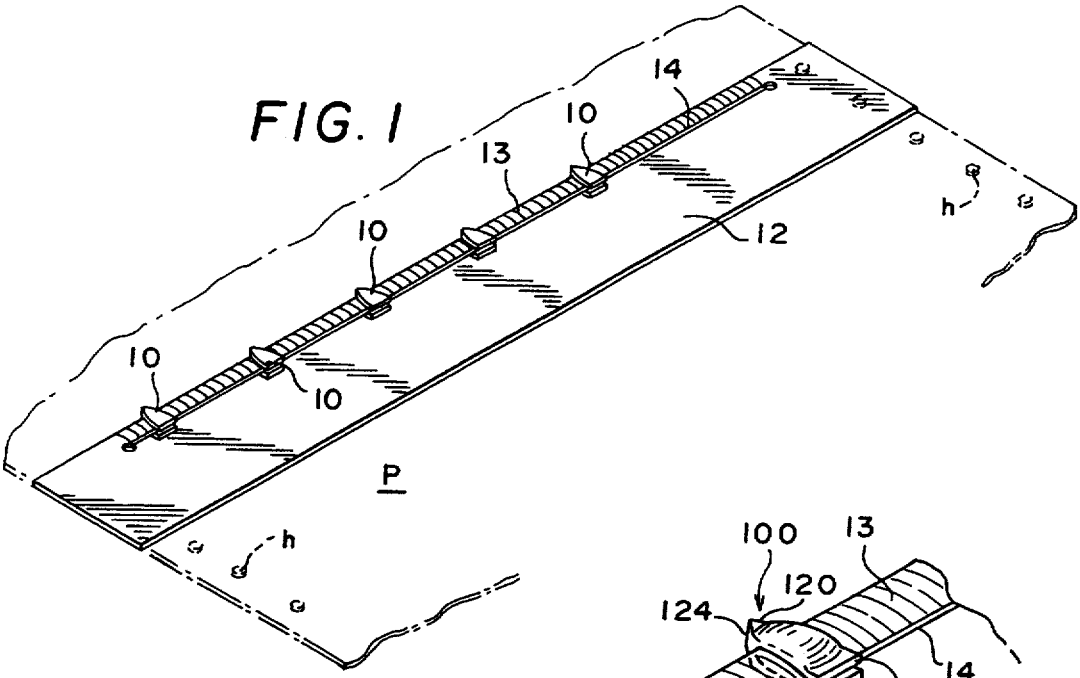
FIG. 1
FIG. 3
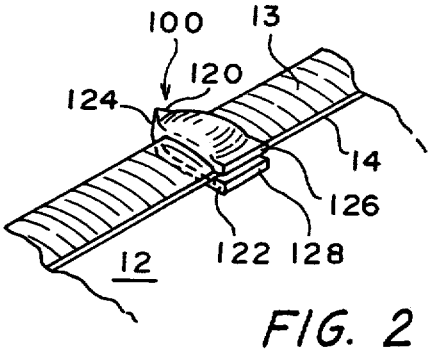
FIG. 2
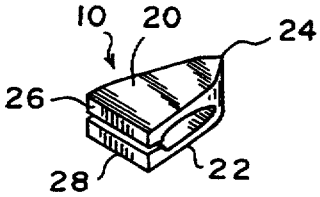
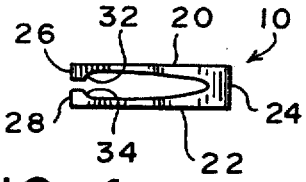
FIG. 4
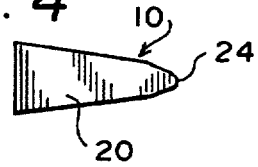
FIG. 5
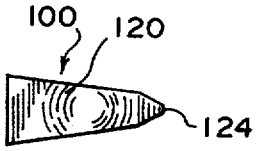
FIG. 7
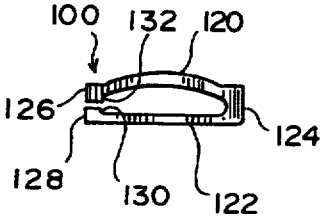
FIG. 6

COLUMN LOCATOR FOR COMPUTER PAGE PLACE MARKER

BACKGROUND OF THE INVENTION

The present invention relates to a column locator for printed material having a series of columns of information, and in particular, to a column locator suitable for use with a computer page place marker.

In my previous U.S. Pat. No. 4,799,812, entitled *Computer Page Place Marker*, a flexible elongated transparent computer page place marker is provided having a longitudinal marking surface for locating specific printed lines of information on a standard computer page. The marker includes a longitudinal slit positioning a plurality of column locators within the slit and slidably moveable therein for locating column information on a computer page. The locators of the prior patent are made of plastic and are overlapped in order to encircle a longitudinal portion of the marker formed by the slit and the peripheral edge thereof. The upper portion of the locator is preferably pointed to aid in locating specific columns.

The present invention relates to an improved column locator structure for use with the computer page place marker. The locator is a bifurcated member having an end shaped in the form of a pointer. The legs are structured to engage the computer page place marker so as to be slidably moveable thereon. The legs are integrally formed with the pointer in a "U" shape when viewed in elevation.

Among the objects of the present invention is to provide an improved column locator for use with a computer page place marker which is simple in design and easy to install on the marker and the provision of a column locator having legs for engaging a computer page place marker and an integral pointer for use in locating columns of information on a computer page. Other objects of the invention will become apparent with reference to the following drawings and written description as follows.

DESCRIPTION OF THE DRAWINGS

FIG. 1 is a perspective view of a series of column locators of the present invention, as it is used on a computer page place marker.

FIG. 2 is a perspective view of a second embodiment of a column locator on a computer page place marker.

FIG. 3 is a perspective view of a column locator in accordance with the present invention.

FIG. 4 is a side elevational view thereof.

FIG. 5 is a top plan view thereof.

FIG. 6 is a side elevational view of the second embodiment of the present invention.

FIG. 7 is a top plan view of the locator of FIG. 6.

DESCRIPTION OF THE PREFERRED EMBODIMENTS

Referring to the drawings, FIGS. 1 and 2 show column locators 10 in accordance with the present invention in place on a computer page place marker 12. The locators 10 are slidable on the place marker 12 on a raised longitudinal track 13 and in a longitudinal slit 14 and are moveable therein to locate columns on a computer page in the same manner as described in my previous U.S. Pat. No. 4,799,812. The place marker 12 is shown with five column locators 10, although more or less numbers of these locators may be provided with a particular place marker, depending upon the size of the computer paper it is used with and the requirements for locating columns.

Referring to FIGS. 3, 4 and 5, the locator 10 is bifurcated and formed of a flat upper leg 20 and a flat lower leg 22 integrally attached by a pointer 24 at the front end so that each leg is parallel with the other, as shown in FIG. 5. Both legs 20 and 22 are flexible, allowing them to be opened and separated from each other for insertion on a computer page place marker 12. When in place, the legs 20 and 22 return to a more closed position. Lips 26 and 28 formed on the inner ends of each leg 20 and 22, respectively, include shoulders 32 and 34 which engage the edge of the place marker 12 and prevent the column locator from coming off the place marker when the locator is in place. The pointer 24 facilitates locating a particular column as the locator 10 is moved along a place marker.

FIGS. 2, 6 and 7 show a second embodiment of a locator 100, including an upper leg 120, a lower leg 122, and a pointer 124. Lips 126 and 128 and shoulders 130 and 132 are provided on the ends of each leg 120 and 122 as with the embodiment described hereinabove to maintain it in place when it is used on a computer page place marker. In this embodiment, the upper leg 120 is arcuate, or curved, in shape and the lower leg 122 is flat, as seen in the side elevational view of FIG. 6. This structure facilitates gripping the locator with the fingertip and moving it on a locator 12 when using it to locate a column of information on a computer page.

The improved structure of the column locator of the present invention enables the locator to be easily attached to or removed from a computer page place marker by spreading the legs to a more open position and simply sliding the open end of the locator into the longitudinal slit on the place marker. After the locator engages the place marker, the legs are released and resume a more closed position to lock the locator in place. The shoulders on each of the lips engage a longitudinal edge of the place marker, keeping the locator in position and allowing the locator to be easily slid in a longitudinal direction and stopped adjacent a particular column of information to be marked.

Whereas specific embodiments of the present invention have been described, it will be appreciated that the column locator may assume other equally functional shapes such as triangular, without departing from the spirit and scope of the present invention, as defined in the following claims.

I claim:

1. A column locator in combination with an elongated page place marker having a generally planar top and bottom surface and a longitudinal edge; said locator being slidably moveable along said longitudinal edge of said place marker for locating columns of information on a printed computer page, comprising:

a U-shaped member having a jaw-like opening on a first end of said member for engagement of the place marker therein; said member formed by a pair of flexible, bifurcated upper and lower legs;

a pointer formed on a second end of said member cooperatively joining each of said legs; said pointer located on the opposite end of said opening and pointing outwardly therefrom; and, means for maintaining said locator on the place marker during movement of said locator thereon; said means including at least one lip and shoulder adjacent the opening on said first end of said member and extending into said opening, wherein said shoulder engages the longitudinal edge of said place marker.

2. The locator of claim 1 wherein said legs are resilient, permitting the opening formed therewith to be expanded for engagement of the place marker.

3. The locator of claim 1 wherein said shoulder is formed on an inner edge of said lip and within said opening.

4. The locator of claim 1 wherein each of said legs has a lip and shoulder thereon, both extending into said opening.

5. The locator of claim 1 wherein said upper one of said legs includes an outer arcuate surface portion.

6. The locator of claim 1 wherein the entire outer surface of said lower leg is flat and lies in a single horizontal plane.

7. A column locator for use in combination with an elongated page place marker; said locator being slidably moveable along a longitudinal edge of said place marker for locating columns of information on a printed computer page; comprising:

a U-shaped member having a jaw-like opening on a first end of said member for engagement of the place marker therein; said member formed by a pair of flexible, bifurcated upper and lower legs;

a pointer formed on a second end of said member cooperatively joining each of said legs; said upper leg including an outer arcuate surface portion to facilitate moving of the location by the finger of a user said lower leg having an outer surface which is flat; said pointer located on the opposite end of said opening and pointing outwardly therefrom; and, means for maintaining said locator on the place marker during movement of said locator thereon; said means including at least one lip and shoulder adjacent the opening on said first end of said member and extending into said opening for engaging an edge of said place marker.

8. The locator of claim 1 wherein the entire surface of said upper leg is flat and lies in a single horizontal plane.

* * * * *